US007997948B2

(12) United States Patent
Fraser et al.

(10) Patent No.: US 7,997,948 B2
(45) **Date of Patent: *Aug. 16, 2011**

(54) HYBRID WATER SPORT APPARATUS

(75) Inventors: Michael Fraser, San Diego, CA (US); Craig Hall, Alhambra, CA (US); Nick Martushev, Beavercreek, OR (US)

(73) Assignee: Finnys LLC, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/702,088

(22) Filed: Feb. 8, 2010

(65) Prior Publication Data

US 2010/0279562 A1 Nov. 4, 2010

Related U.S. Application Data

(63) Continuation of application No. 12/182,823, filed on Jul. 30, 2008, now Pat. No. 7,658,659.

(51) Int. Cl.
*A63B 31/08* (2006.01)

(52) U.S. Cl. ..... 441/64; 441/63

(58) Field of Classification Search ..... 441/61, 441/62, 63, 64

See application file for complete search history.

(56) References Cited

U.S. PATENT DOCUMENTS

| | | | | |
|---|---|---|---|---|
| 1,688,498 | A | 10/1928 | Jacobson | |
| 2,980,926 | A | 4/1961 | Wolshin | |
| 3,178,738 | A | 4/1965 | LaTrell | |
| 4,599,071 | A | 7/1986 | Juang | |
| 5,292,272 | A | 3/1994 | Grim | |
| 5,746,631 | A | 5/1998 | McCarthy | |
| 5,924,902 | A | 7/1999 | Burns et al. | |
| 6,155,898 | A | 12/2000 | Burns et al. | |
| 6,540,574 | B2 | 4/2003 | Hashizume et al. | |
| 7,159,336 | B2 | 1/2007 | Burns et al. | |
| 7,658,659 | B1 * | 2/2010 | Fraser et al. | 441/64 |
| 7,828,615 | B2 * | 11/2010 | Bonis et al. | 441/61 |
| 2002/0088140 | A1 | 7/2002 | Wang et al. | |
| 2008/0172904 | A1 | 7/2008 | Pelsue et al. | |

OTHER PUBLICATIONS

International Search Report and Written Opinion for International Application No. PCT/US2009/050368, mailed Sep. 2, 2009, 8 pages.
Office Action mailed Sep. 4, 2009 for U.S. Appl. No. 12/182,823, filed Jul. 30, 2008, 6 pages.

* cited by examiner

*Primary Examiner* — Lars A Olson
(74) *Attorney, Agent, or Firm* — Cooley LLP

(57) ABSTRACT

An apparatus includes an upper portion, a sole and a fin. The upper portion is configured to at least partially cover a foot. The sole is coupled to the upper portion and defines a cavity. The fin has a first portion and a second portion. The fin is movable between a first configuration and a second configuration. When in the first configuration, the fin is substantially within the cavity defined by the sole, and the first portion of the fin at least partially overlaps the second portion of the fin. When in the second configuration, the fin extends substantially outside the cavity defined by the sole.

19 Claims, 11 Drawing Sheets

HYBRID WATER SPORT APPARATUS

CROSS-REFERENCE TO RELATED APPLICATIONS

This application is a continuation of U.S. application Ser. No. 12/182,823, filed on Jul. 30, 2008, entitled "Hybrid Water Sport Footwear," now U.S. Pat. No. 7,658,659, which is incorporated herein by reference in its entirety.

FIELD OF THE INVENTION

The invention relates generally to footwear that may be used for both walking and swimming and more particularly to an amphibious shoe that permits simple conversion between a walking mode and a swimming mode.

BACKGROUND OF THE INVENTION

Swim fins commonly used in water sports, such as, for example swimming and scuba diving, function to increase the propulsive force of the legs by substantially increasing the surface area of the foot. Although numerous styles of swim fins are known, most swim fins are cumbersome and impractical for walking and may even present potential danger to the wearer. To overcome such deficiencies, various types of swim fins and shoe combinations, including designs capable of folding or rotating between a swimming mode and a walking mode, have been developed.

Known swim fin and shoe combinations include, for example, amphibious shoe-like structures with fin blades having a swimming mode and a walking mode. When in the walking mode, the swim fin can rest adjacent to a wearer's instep. When in the swimming mode, the swim fin can extend from the shoe-like structure. In such a device, the expandable fin blade can move between the swimming mode and the walking mode by rotating the fin blade towards the instep of the shoe about a pivoting point such as a rivet, pin, screw or nut and bolt assembly.

Other known swim fin and shoe combinations allow the fin to move between the swimming mode and walking mode through a cut-out in the toe of a hollow sole. Such know devices, however, require folding or bunching up the fin into the sole of the shoe when the fin is in the walking mode. Such folding can create an uneven shoe sole which can cause discomfort when the fin is in the walking mode.

Other know swim fin and shoe combinations include flippers that are extensible through cut-outs in the toe of the hollow sole by means of springs and pins. Such a device requires a separate guard piece to restrain the flipper within the hollow sole. Still other known fin and shoe combinations include fins that can be detached from the shoe and secured to the shoe in a different position by separate screws. Such devices can be cumbersome to move between the swimming mode and the walking mode. Additionally, such devices have hardware that can be lost and/or can corrode.

Therefore a need exists for an amphibious shoe, which can be used for walking and swimming, having convenient, relatively inexpensive and secure means for converting between a walking mode and a swimming or diving mode and maintaining the amphibious shoe in the desired mode. There also exists a need for an amphibious shoe that is comfortable for the wearer and does not restrict the activities of the wearer when in the walking mode. Additionally, a need exists for a swim fin and shoe combination that can be fabricated from moldable thermoplastic materials without corrosion-prone hardware. Further, a need exists for a swim fin and shoe combination with a reliable, reversible retaining mechanism and a minimum of mechanical parts.

SUMMARY

In some embodiments, an apparatus includes an upper portion, a sole and a fin. The upper portion is configured to at least partially cover a foot. The sole is coupled to the upper portion and defines a cavity. The fin has a first portion and a second portion. The fin is movable between a first configuration and a second configuration. When in the first configuration, the fin is substantially within the cavity defined by the sole, and the first portion of the fin at least partially overlaps the second portion of the fin. When in the second configuration, the fin extends substantially outside the cavity defined by the sole.

DETAILED DESCRIPTION

Figure 1:
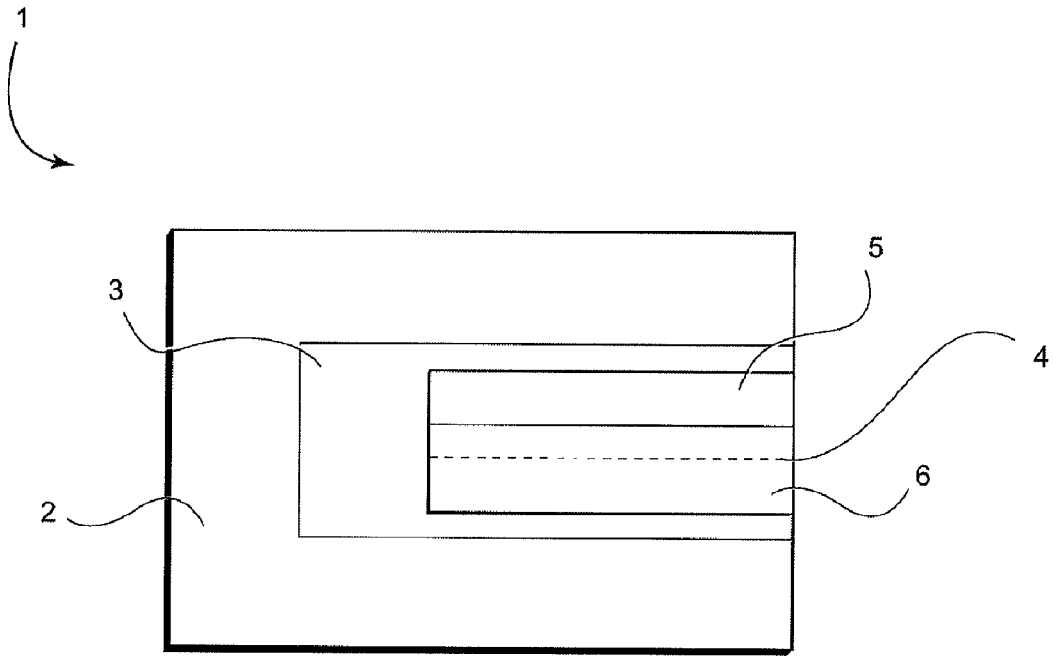
FIGS. 1-2 depict schematic illustrations of an apparatus in a first configuration and a second configuration, respectively, according to an embodiment.

Some embodiments include an amphibious shoe including a shoe component and a swim fin component. The shoe component consists of a shoe upper (also referred to herein as a shoe top or upper body) attached (e.g., fixedly attached) to a shoe sole. The shoe component has a toe end and a heel end. A sole cavity is defined by a top surface, a bottom surface and two side walls of the shoe sole. The sole cavity extends longitudinally from a closed heel end to an open toe end and is configured to receive the fin component. The fin component has a proximal end and a distal end wherein the distal end has one or more blades or flipper portions that function as swimming aids. The fin component has an extended position and a retracted position. When in the retracted position, the proximal end of the fin component is disposed within the heel end of the sole cavity and the fin component is disposed within the sole cavity. When in the extended position, the proximal end of the fin component is disposed within the toe end of the sole cavity and the distal end of the fin component extends through the open toe end of the sole cavity such that the one or more blades are not disposed within the sole cavity.

In certain embodiments, the distal end of the fin component has two blades that move relative to one another in a scissor-like fashion as the fin component is extended and that move together relative to one another in a scissor-like fashion as the fin component is retracted into the sole cavity such that at least portions of the two individual fin blades overlap when the fin component is in a retracted position.

In some embodiments, the cavity defined by the shoe sole is shaped such that it is essentially the same width at each point along its length. In other embodiments, the cavity defined by the shoe sole is shaped such that it is narrower at the heel end and/or the toe end, than the proximal end of the swim fin component. In such embodiments, the proximal end of the swim fin component is laterally compressed when disposed within the heel end and/or the toe end of the cavity. The proximal end of the swim fin component is constructed of a material with sufficient elasticity to recover from compressive deformation. This elasticity helps facilitate the extension and retraction of the swim fin component. Further, the proximal end of the swim fin component provides a user's foot with necessary resistance during the kicking motion of swimming.

In some embodiments, the proximal end of the swim fin component defines one or more voids or holes. In such embodiments the proximal end of the fin component is afforded lateral compressibility and recovery, the level of which is governed by the number, size and shape of the voids or holes as well as the elasticity of the material of construction.

In certain other embodiments of the swim fin component, the proximal end is configured to essentially define a chevron or "V" shaped crossbar. In such embodiments the proximal end of the fin component is afforded lateral compressibility and recovery the level of which is governed by the size and shape of the chevron or "V" shaped crossbar as well as the elasticity of the material of construction.

In certain embodiments, the sole component defines a cavity and is fabricated from two or more components fixedly attached to one another. For example, a three element sole component may have an inner sole, a midsole and an outer sole wherein the midsole has a recess that extends along the longitudinal axis from an area within the heel end through the toe end, thus providing a midsole component with a closed heel end and an open toe end. The combination of such a recessed midsole component and an inner sole component define the necessary cavity to house the fin component. The outer sole can have a suitable tread design, pod configuration or the like to enhance the use of the amphibious shoe in the walking mode.

As used in the specification, the word "shoe" means any type of conventional footwear. This includes sandals, running shoes, boots, slippers and the like. Furthermore, the term "shoe" may be used interchangeably with the term "conventional footwear" and/or any type of conventional footwear.

Figure 2:
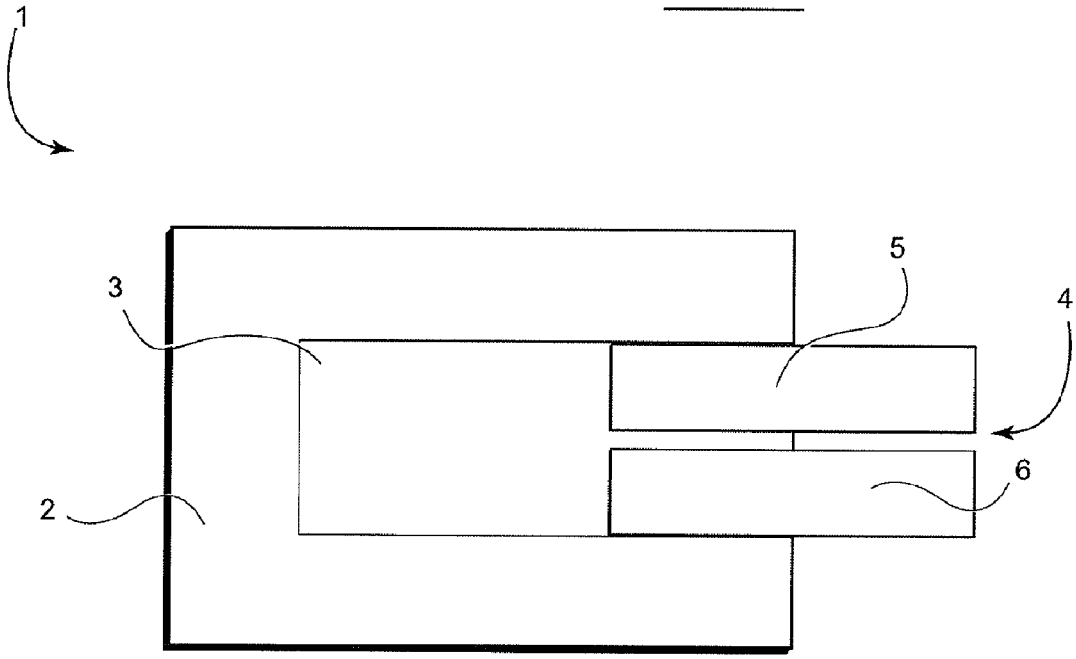

FIGS. 1 and 2 are schematic illustrations of an apparatus 1 according to an embodiment. The apparatus 1 includes a sole 2 and a fin 4. The sole 2 defines a cavity 3. The cavity 3 is shaped such that the fin 4 can be disposed within the cavity 3, as described in further detail herein. The sole 2 can be attached to an upper portion of a shoe (not shown) configured to receive a foot. In this manner, a user can wear the apparatus 1 on a foot.

The fin 4 includes a first portion 5 and a second portion 6. The first portion 5 of the fin 4 is physically distinct from the second portion 6 of the fin 4. Said another way, a distal end portion of the first portion 5 of the fin 4 is not coupled to a distal end portion of the second portion 6 of the fin 4. Because the first portion 5 of the fin 4 is physically distinct from the second portion 6 of the fin 4, the first portion 5 of the fin 4 can be moved with respect to the second portion 6 of the fin 4, and vice versa.

The fin 4 has a first configuration (see e.g., FIG. 1) and a second configuration (see e.g., FIG. 2). The fin 4 is configured to be disposed within the cavity 3 defined by the sole 2 when in the first configuration. A portion of the first portion 5 of the fin 4 overlaps a portion of the second portion 6 of the fin 4 when the fin 4 is in its first configuration. In other embodiments, the first portion of the fin does not overlap the second portion of the fin when the fin is in its first configuration. When the fin 4 is in the first configuration, the apparatus 1 can be used as conventional footwear. For example, the apparatus 1 can be attached to a foot such that a user can use the apparatus as conventional footwear.

As shown in FIG. 2, a portion of the fin 4 is disposed outside the cavity 3 defined by the sole 2 when the fin 4 is in the second configuration. The first portion 5 of the fin 4 and the second portion 6 of the fin 4 do not overlap when the fin 4 is in the second configuration. In this manner, the fin 4 can have a width in the second configuration that is greater than a width of the fin 4 in the first configuration. In other embodiments, a portion of the first portion of the fin and a portion of the second portion of the fin overlap when in the second configuration. The apparatus 1 can be configured to be aquatic footwear when the fin 4 is in the second configuration. For example, the fin 4 is configured to assist a user in displacing a greater amount of water when in the second configuration. In this manner, the apparatus 1 can be worn as a swimming fin.

The fin 4 is movable between the first configuration and the second configuration. For example, a user can move the fin 4 from the first configuration to the second configuration to expose the fin 4 to the area outside the cavity 3. In some embodiments, the user moves the fin 4 from the first configuration to the second configuration by sliding a rod attached to the fin 4 from a first position to a second position. Because the rod is attached to the fin 4, sliding the rod causes the fin 4 to correspondingly slide from the first configuration to the second configuration. As described in further detail herein, in other embodiments, the user moves the fin from the first configuration to the second configuration by pressing a button, pulling a cord, pulling the fin, and/or the like.

When a user moves the fin 4 from the first configuration to the second configuration, the first portion 5 of the fin 4 and the second portion 6 of the fin 4 move apart from each other such that the fin 4 has a width in the second configuration that is greater than a width of the fin 4 in the first configuration, as described above. Once in the second configuration, the user can use the apparatus 1 as a swimming fin, as described above.

When the user moves the fin 4 from the second configuration to the first configuration, side walls of the sole 2 that define the cavity 3 force the first portion 5 of the fin 4 and the second portion 6 of the fin 4 towards each other. The first portion 5 of the fin 4 then overlaps the second portion 6 of the fin 4. In this manner, the width of the fin 4 decreases as the fin 4 moves into the cavity 3 defined by the sole 2. Said another way, moving the fin 4 between the first configuration and the second configuration, causes the first portion 5 of the fin 4 and the second portion 6 of the fin 4 to move in scissor-like fashion with respect to each other. Once in the first configuration, a user can use the apparatus 1 as a walking shoe.

Figure 3:
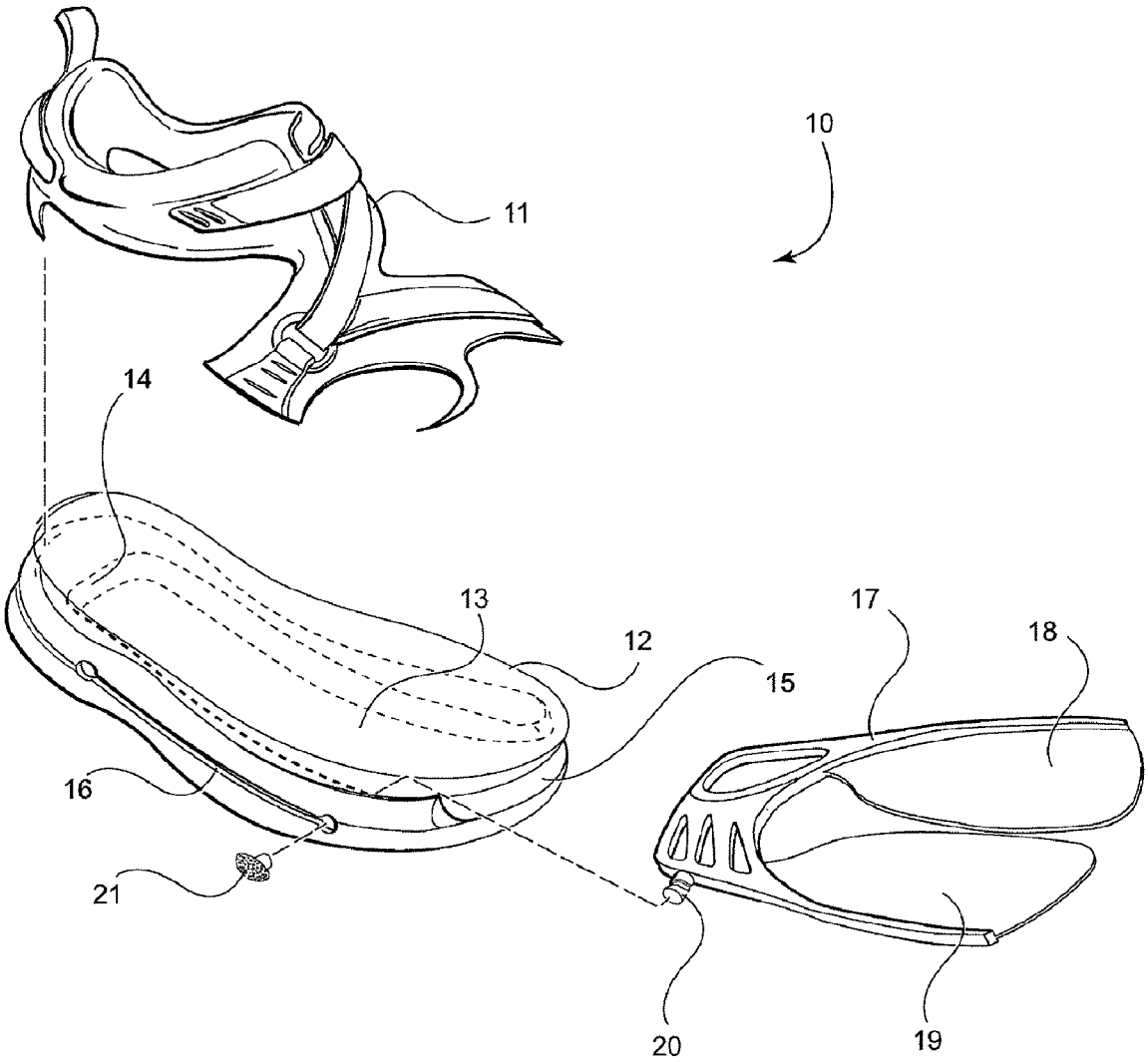
FIG. 3 depicts an exploded isometric view of an embodiment of amphibious shoe with the swim fin component in an extended position.

FIG. 3 shows an exploded isometric view that illustrates the overall relationship between components of an embodiment of an amphibious shoe 10. The amphibious shoe 10 includes a shoe upper 11 attached to a shoe sole 12 wherein each shoe component has a toe end and a heel end. The shoe sole 12 is configured to define a sole cavity 13 having a top surface, a bottom surface and two side walls. The sole cavity 13 extends longitudinally from a closed heel end 14 to an open toe end 15. The sole cavity 13 is dimensioned to receive a swim fin component 17. The swim fin component 17 is slidably disposed within the sole cavity 13 such that the swim fin component 17 can be extended from and retracted into the sole cavity 13. The shoe sole 12 defines a side slot 16 extending from the heel end to the toe end along the longitudinal axis and extending completely through a sidewall from the outside of the shoe sole 12 to the interior of the sole cavity 13.

Attached to an edge of a proximal end portion of the swim fin component 17 is a gripping member 20 that is sized to extend through the side slot 16 from the interior of the sole cavity 13 to the outside of the shoe sole when the swim fin component 17 is disposed within the sole cavity 13. The gripping member 20 can be, for example, a rod or a cylindrical pin. A retainer 21 is coupled to the gripping member 20. The gripping member 20 serves to provide the user with a convenient method for the extension and retraction of the swim fin component 17, while the retainer 21 maintains the swim fin component 17 in either an extended or a retracted position. The distal end of the swim fin component 17 has a first blade 18 and a second blade 19 that function as swimming aids. When the swim fin component 17 is in a retracted position the proximal end portion of the swim fin component 17 is disposed within the heel end of the sole cavity 13 and the entire swim fin component 17 resides within the sole cavity 13. In other embodiments, a portion of the swim fin component is disposed outside the sole cavity when the swim fin component is in the retracted position. When the swim fin component 17 is in an extended position the proximal end portion of the swim fin component 17 resides in the toe end of the sole cavity 13 and a distal end portion extends through the open toe end 15 of the sole cavity 13 such that the blades 18, 19 are disposed outside of the sole cavity 13.

The shoe upper 11 is shown as a shoe having straps configured to attach the shoe upper 11 to a foot of a user. The shoe upper 11, however, can be similar to any type and/or style of shoe. For example, in some embodiments the shoe upper can be a closed shoe where the foot of the user is substantially enclosed within the shoe upper. In other embodiments the shoe upper can be a sandal where the foot of the user is substantially exposed to the area surrounding the shoe upper. In yet other embodiments, the shoe upper can be any known shoe.

In some embodiments one or more of the various shoe components can define one or more outlet lumens configured to allow a liquid such as water to pass from within the shoe to the area surrounding the shoe. Such outlet lumens enhance the drainage of liquid from the shoe. For example, the shoe upper 11 can have outlet lumens configured to drain a liquid from the area surrounding the foot of a user to the area surrounding the shoe upper 11.

In some embodiments, the open toe end can include a cover (not shown). The cover can be configured to extend over the opening in the toe end of the shoe. Such a cover protects the sole cavity and the swim fin component. Further, such a cover prevents debris, such as sand, from entering the sole cavity. The cover can be a flap that is hingedly coupled to the toe end of the shoe such that when the swim fin component is moved from the retracted position to the extended position the flap hinges and allows the distal end portion of the swim fin component to exit the sole cavity. In other embodiments, the cover can be manually removed and replaced when the swim fin component is moved between the extended position and the retracted position.

Figure 4:
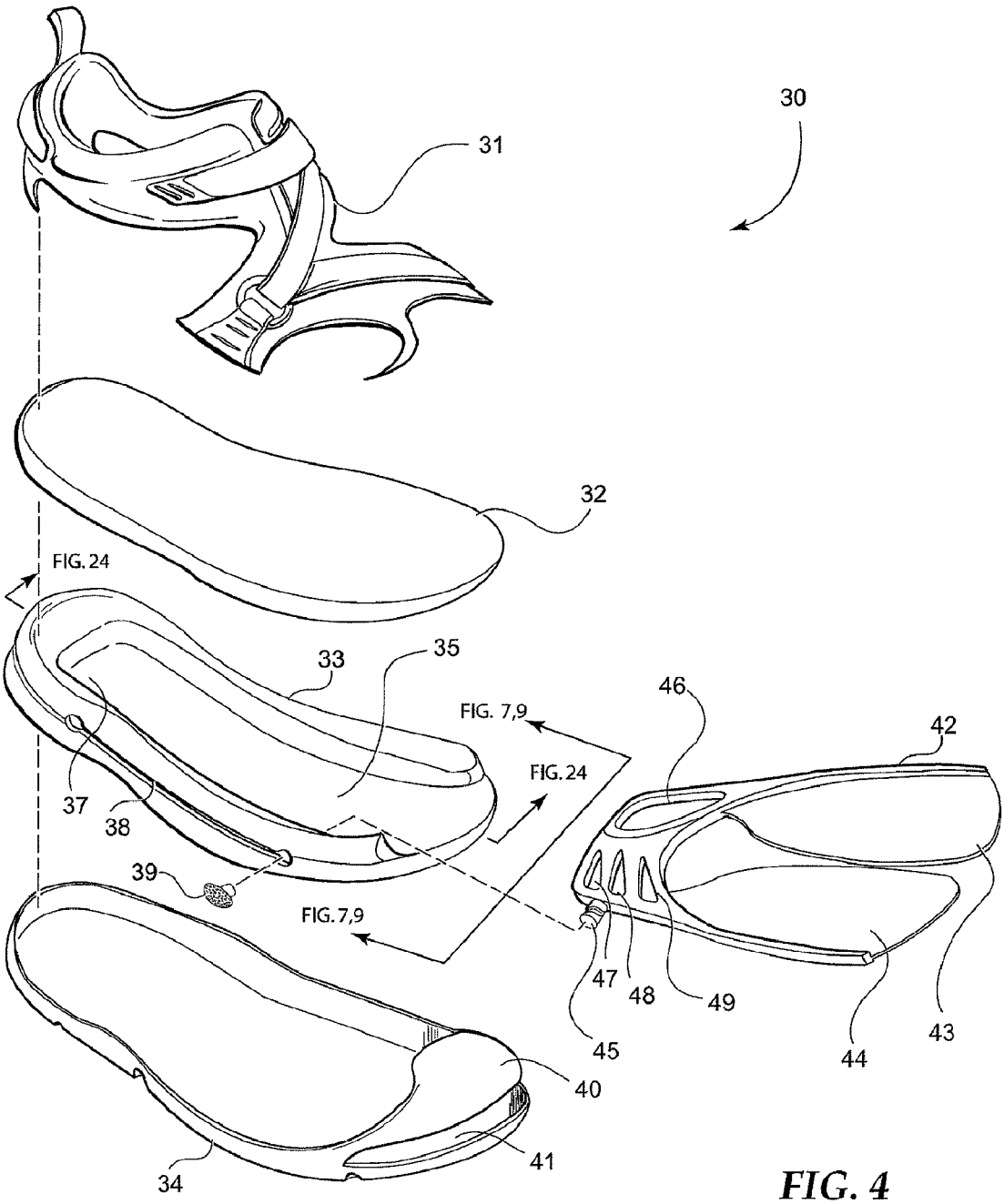
FIG. 4 depicts an exploded isometric view of an embodiment of an amphibious shoe with a swim fin component in an extended position.

FIG. 4 shows an exploded isometric view of an amphibious shoe 30, according to an embodiment. The amphibious shoe 30 consists of a shoe portion having a shoe upper body 31, an inner sole 32, a midsole 33 and an outer sole 34. The midsole 33 is configured to define a midsole recess 35 extending from within a heel end along a longitudinal axis defined by the midsole 33 and through a toe end such that the midsole 33 has an open toe end 36 and a closed heel end 37. Also disposed along the longitudinal axis of the midsole 33 is a side slot 38 that extends through the sidewall of the midsole 33 from the interior of the midsole recess 35. As shown in FIG. 4, the outer sole 34 has an integral bull nose structure 40 with a slotted toe opening 41 configured to allow a swim fin component 42 to move into or out of a cavity defined by the midsole recess 35 and the inner sole 32. Such a bull nose structure 40 provides reinforcement and stability to the toe portion.

Amphibious shoe 30 also includes a swim fin component 42. The swim fin component 42 includes a distal end portion having two physically distinct blade elements 43 and 44 and a proximal end portion having a geometrical configuration that defines voids 46, 47, 48 and 49 extending through the thickness of the swim fin component 42. When the swim fin component 42 is in the retracted position it is disposed within the cavity defined by the midsole recess 35 and the outer sole 34. A protruding rod 45 that is configured to extend through the open side slot 38 is fixedly attached to an edge of the proximal end portion of the swim fin component 42. A retainer 39 is coupled to the protruding rod 45. The protruding rod 45 serves as a gripping member to provide the user with a convenient method for the extension and retraction of the swim fin component 42, while the retainer 39 aids in the retention of the swim fin component 42 in either an extended position or a retracted position. In some embodiments, the protruding rod 45 has a screw thread and the retainer 39 is a mated nut.

Figure 5:
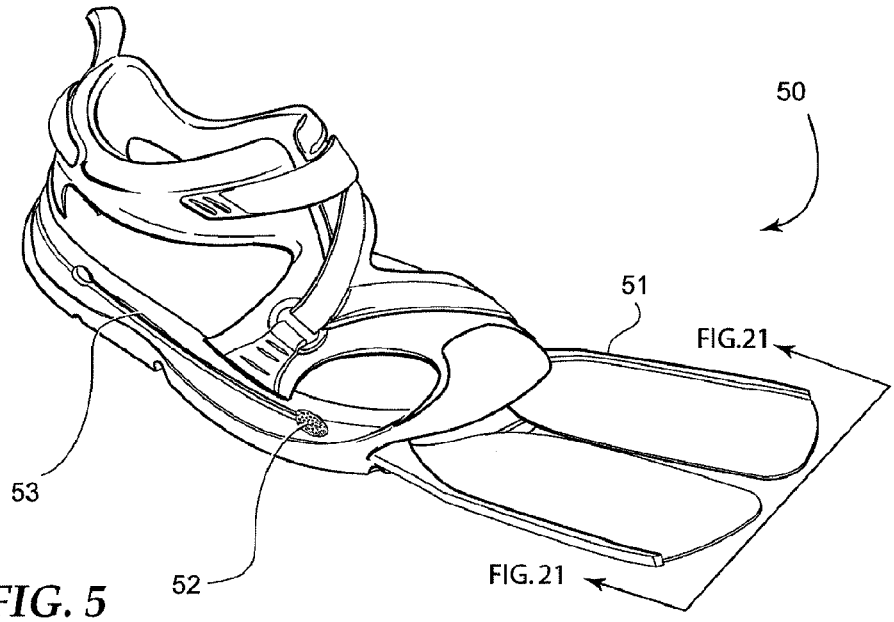
FIG. 5 depicts an isometric view of an amphibious shoe with the swim fin component in the extended position, according to an embodiment.
Figure 6:
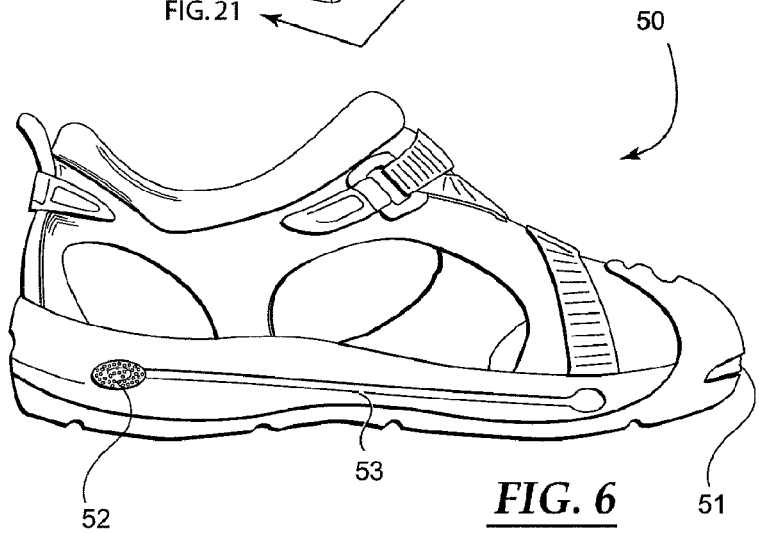
FIG. 6 depicts an orthogonal side view of the amphibious shoe shown in FIG. 5 with the swim fin component in a retracted position.
Figure 7:
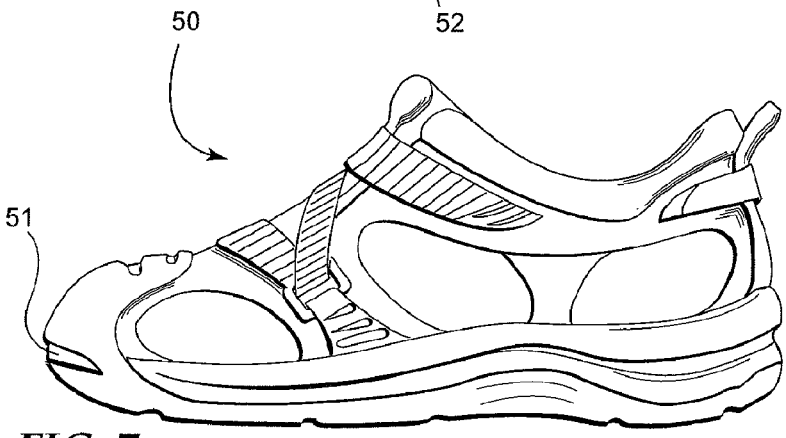
FIG. 7 depicts an orthogonal view from the side opposite the side depicted in FIG. 6 of the amphibious shoe shown in FIG. 5 with the swim fin component in a retracted position.

Illustrations of a fully assembled embodiment of an amphibious shoe 50 are presented in FIGS. 5, 6 and 7. FIG. 5 is an isometric view of an amphibious shoe 50 having a swim fin component 51 in an extended position, FIG. 6 is an orthogonal side view of the amphibious shoe 50 with the swim fin component 51 in a retracted position, and FIG. 7 is an orthogonal view of the side opposite the side depicted in FIG. 6 of the amphibious shoe 50 with the swim fin component 51 in the retracted position. A retainer 52 is disposed at the toe end of an open side slot 53, when the swim fin component 51 is in the extended position (see e.g., FIG. 5). The retainer 52 is disposed at the heel end of the open side slot 53, when the swim fin component 51 is in the retracted position (see e.g., FIG. 6). The swim fin component 51 includes two separate blade elements that are structurally and functionally similar to the blades described above.

Figure 8:
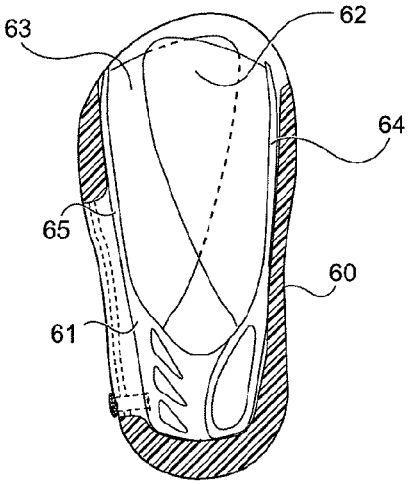
FIGS. 8 and 9 depict top orthogonal views of a swim fin component in a retracted position and an extended position, respectively, according to an embodiment.
Figure 9:
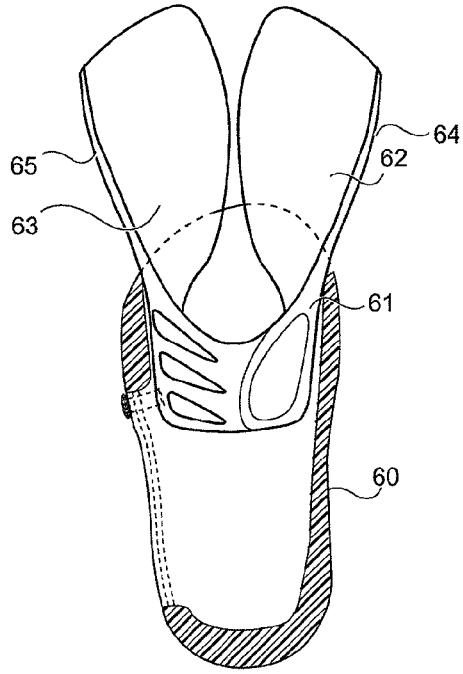
Figure 10:
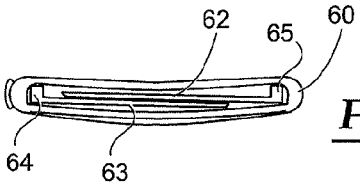
FIG. 10 depicts a frontal orthogonal view of the swim fin component shown in FIG. 8 in a retracted position.

FIG. 8 shows a top orthogonal view of a swim fin component 61 including a first blade 62 and a second blade 63, disposed in a retracted position within a cavity defined by a shoe sole 60. FIG. 9 shows a top orthogonal view of the swim fin component 61 of FIG. 8 disposed in an extended position. The cavity defined by the shoe sole 60 is narrower at a heel end than at a toe end such that the proximal end of the swim fin component 61 is laterally compressed when disposed within the heel end of the cavity. FIG. 10 shows a front orthogonal view of the shoe sole 60 with the swim fin component 61 disposed within the cavity defined by the shoe sole 60.

The first blade 62 and the second blade 63 of the swim fin component 61 include a first blade rib 64 and a second blade rib 65 disposed along the outer edges of the first blade 62 and the second blade 63, respectively. The blade ribs 64, 65 serve multiple functions. When the swim fin component 61 is in the extended position (see e.g., FIG. 9), the blade ribs 64, 65 provide a degree of stiffness and support to the blades 62, 63 which aids the amphibious shoes to function in the extended position. Said another way, the blade ribs 64, 65 help the blades 62, 63 to effectively displace water. Further, when the swim fin component 61 is in the retracted position (see e.g., FIG. 8), the blade ribs 64, 65 are laterally compressed due to the pressure exerted by the edges of the cavity. In this manner, the blade ribs 64, 65 aid retention of the swim fin component 61 within the shoe sole 60 when the swim fin component 61 is in the retracted position.

The swim fin component 61 is substantially flexible to permit the blades 62, 63 to overlap in a scissor-like fashion as the swim fin component 61 is moved from the extended position to the retracted position. Such scissoring movement of the blades 62, 63 is effected by the flexibility of the various elements of the swim fin component 61, which is in turn a function of design and selection of materials of construction. The overlapping relationship between the blades 62, 63 of the swim fin component 61 in the retracted position is depicted in FIG. 8, wherein a portion of the first blade 62 is disposed above a portion of the second blade 63.

Figure 11:
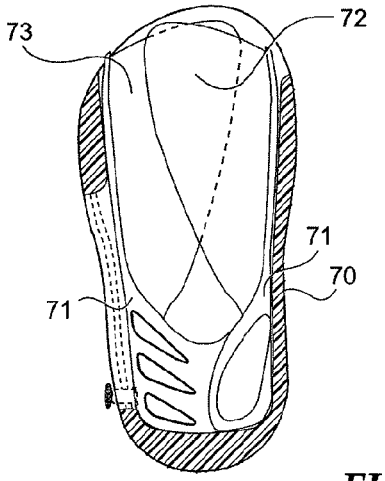
FIGS. 11 and 12 depict top orthogonal views of a swim fin component in a retracted position and an extended position, respectively, according to an embodiment.
Figure 12:
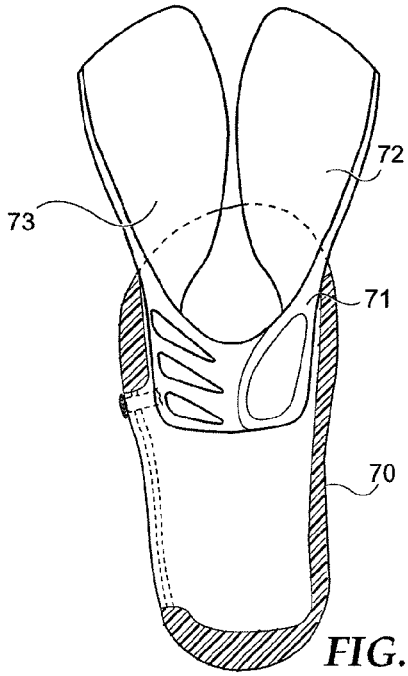

FIG. 11 shows a top orthogonal view of a swim fin component 71 comprising blades 72 and 73, in a retracted position within a cavity defined by a shoe sole 70. FIG. 12 shows a top orthogonal view of the swim fin component 71 of FIG. 11 in an extended position. The cavity defined by the shoe sole 70 is substantially the same width at the heel end and the toe end such that the proximal end of the swim fin component 71 is not laterally compressed when residing in the heel end of the cavity.

Figure 13:
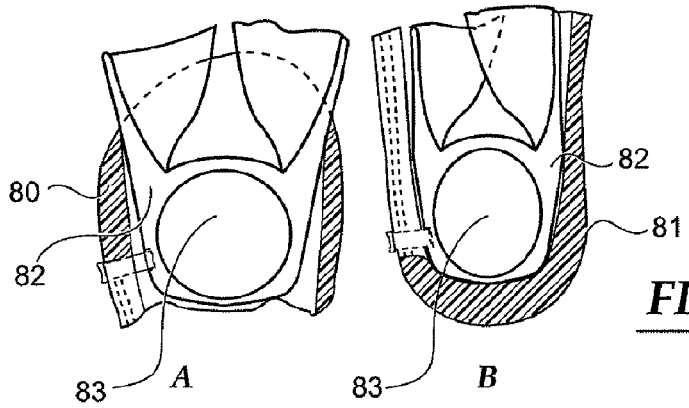
FIGS. 13A and 13B depict partial top orthogonal views of the proximal end of a swim fin component in an extended position and a retracted position, respectively, according to an embodiment.

While shown in FIG. 4 as having a single void 46 on a first side and three voids 47, 48, 49 on a second side, a swim fin component can define any number and have any configuration of voids. For example, FIGS. 13A and 13B show an embodiment of a swim fin component having a proximal end portion 82 that defines a single void 83. When the swim fin component is in the extended position (see e.g., FIG. 13A), the proximal end portion 82 is disposed within a toe end portion 80 of a cavity defined by a shoe sole such that the proximal end portion 82 is in a relaxed non-compressed state. When the swim fin component is in the extended position the void 83 defined by the proximal end portion 82 is substantially circular. When the swim fin component is in the retracted position (see e.g., FIG. 13B), the proximal end portion 82 of the swim fin component is disposed within a heel end portion 81 of the shoe sole cavity such that the proximal end portion 82 is laterally compressed by the sides of the heel end portion 81 of the shoe sole cavity. When the swim fin component is in the retracted position, the void 83 defined by the proximal end portion 82 is substantially oval in shape.

The void 83 and the flexibility of the proximal end portion 82 help facilitate the extension and retraction of the swim fin component. The void 83, also helps reduce the weight of the swim fin component. The proximal end portion 82 of the swim fin component also functions as a "foot plate," providing necessary resistance during the kicking motion of swimming. Said another way, as water exerts resistance on a distal end portion of the swim fin component, the proximal end portion 82 of the swim fin component maintains its position within the toe end portion 80 of the cavity defined by the shoe sole. This causes the distal end portion of the swim fin component to remain adequately rigid with respect to the proximal end portion 82 of the swim fin component to exert a force on the water, propelling the user.

Figure 14:
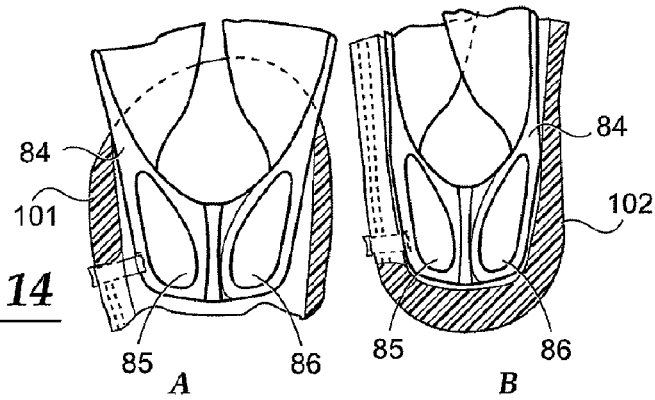
FIGS. 14A and 14B depict partial top orthogonal views of the proximal end of a swim fin component in an extended position and a retracted position, respectively, according to an embodiment.

FIGS. 14A and 14B show an embodiment of a swim fin component having a proximal end portion 84 that defines a first ovoid or egg-shaped void 85 and a second ovoid or egg-shaped void 86. When the swim fin component is in the extended position (see e.g., FIG. 14A), the proximal end portion 84 is disposed within the toe end portion 101 of a cavity defined by a shoe sole such that the proximal end portion 84 of the swim fin component is in a relaxed non-compressed state. When the proximal end portion 84 of the swim fin component is in a relaxed non-compressed state, the voids 85, 86 exhibit a natural geometry. When the swim fin component is in the retracted position (see e.g., FIG. 14B), the proximal end portion 84 of the swim fin component is disposed within a heel end portion 102 of the cavity defined by the shoe sole such that the proximal end portion 84 of the swim fin component is laterally compressed by the sides of the heel end portion 102 of the shoe sole cavity. This compresses the voids 85, 86 such that the voids 85, 86 exhibit an elongated geometry. Similar to the void 83, described above, the voids 85, 86 help facilitate the extension and retraction of the swim fin component and help reduce the weight of the swim fin component.

Figure 15:
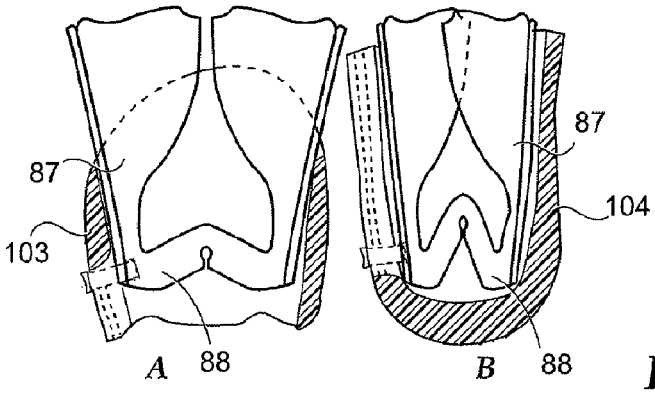
FIGS. 15A and 15B depict partial top orthogonal views of the proximal end of a swim fin component in an extended position and a retracted position, respectively, according to an embodiment.

FIGS. 15A and 15B show an embodiment of a swim fin component having a proximal end portion 87 having a chevron 88 or a V shape. When the swim fin component is in the extended position (see e.g., FIG. 15A), the proximal end portion 87 is disposed within a toe end portion 103 of a shoe sole cavity such that the proximal end portion 84 is in a relaxed non-compressed state and wherein the chevron 88 exhibits a natural geometry. When the swim fin component is in the retracted position (see e.g., FIG. 15B) the proximal end portion 87 is disposed within a heel end portion 104 of the shoe sole cavity such that the proximal end portion 87 is laterally compressed by the sides of the heel end portion 104 of the shoe sole cavity. The compression of the proximal end portion 87 compresses the chevron 88 such that the chevron 88 exhibits an elongated geometry. Similar to the void 83, described above, the chevron 88 helps facilitate the extension and retraction of the swim fin component and helps reduce the weight of the swim fin component.

In other embodiments, the geometrical configuration of the proximal end portion of the swim fin component may include chevrons, V-configurations, H-configurations and/or the like as well as voids of various number, size and/or shape. The geometrical configuration of the proximal end portion of the swim fin component is selected to afford a suitable level of lateral compressibility, which is also effected by the elasticity of the material of construction. Suitable geometrical shapes for voids include, but are not limited to regular shapes such as circles, ovals, squares, rectangles parallelograms, triangles and/or slots and/or a variety of irregular shapes.

Figure 16:
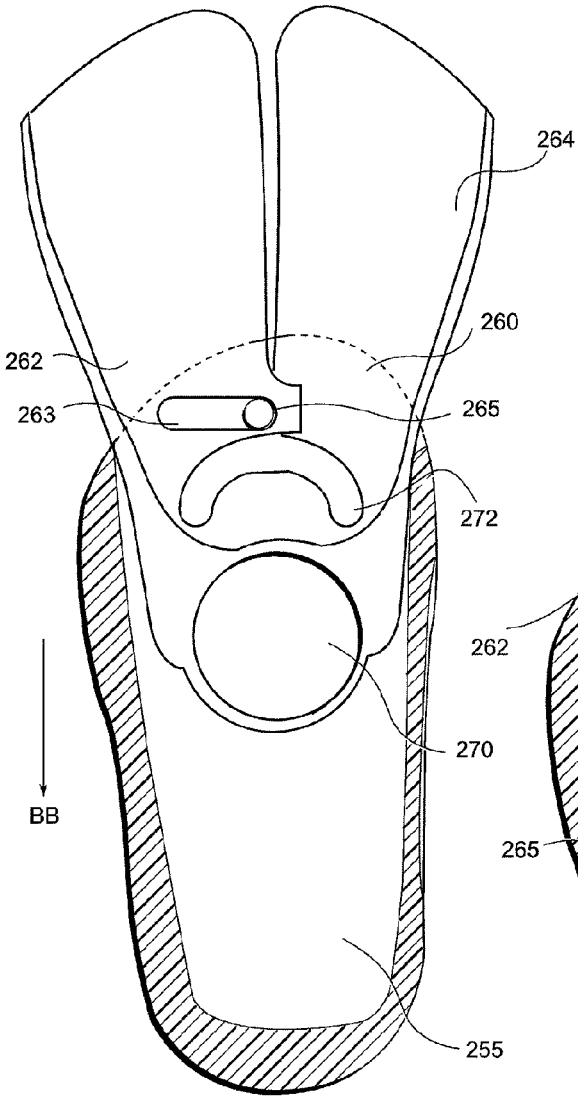
FIGS. 16-17 depict a top view of an amphibious shoe in an extended position and a retracted position, respectively, according to an embodiment.
Figure 17:
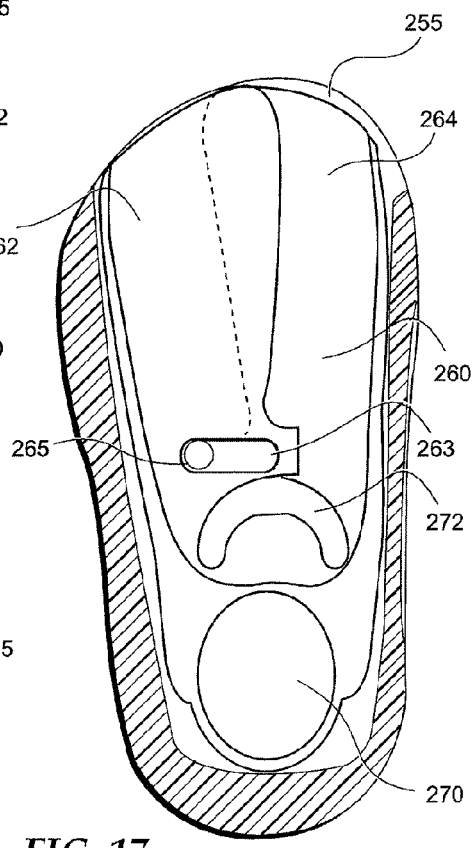

FIGS. 16 and 17 show a top view of a swim fin component 260 in an extended position and a retracted position, respectively, according to an embodiment. When in the extended position, a portion of the swim fin component 260 is disposed outside a cavity defined by a sole 255. When in the retracted position, the swim fin component 260 is disposed substantially within the cavity defined by the sole 255. The swim fin component 260 includes a first blade 262 and a second blade 264. The first blade 262 and the second blade 264 are structurally and functionally similar to the first blade 62 of the swim fin component 61 and the second blade 63 of the swim fin component 61, respectively, as described above. As such, the similarities between the first blade 262 and the first blade 62 and the similarities between the second blade 264 and the second blade 63 are not described in detail herein.

The first blade 262 of the swim fin component 260 defines an aperture 263. The aperture is configured to receive a protrusion 265 of the second blade 264 of the swim fin component 260. The protrusion 265 of the second blade 264 is configured to slide within the aperture 263 defined by the first blade 262 as the swim fin component 260 moves between the extended position (FIG. 16) and the retracted position (FIG. 17). The protrusion 265 is configured to provide additional support to the swim fin component 260 as it moves between the extended position and the retracted position.

The swim fin component 260 also defines a first aperture 270 and a second aperture 272. The first aperture 270 of the swim fin component 260 is structurally and functionally similar to the void 83 described above in relation to FIGS. 13A and 13B. As such, when the swim fin component 260 is in the extended position, the first aperture 270 is in a relaxed non-compressed state, and is substantially circular. When the swim fin component 260 is in the retracted position, the first aperture 270 is laterally compressed by the side walls of the cavity defined by the sole 255. As described above, in other embodiments, the first aperture can be any suitable shape. The second aperture 272 defined by the swim fin component 260 is arc shaped and is configured to allow the first blade 262 and the second blade 264 to move toward each other when moved from the extended position to the retracted position.

In use, a user can move the swim fin component 260 from the extended position (FIG. 16) to the retracted position (FIG. 17) by moving the swim fin component 260 with respect to the sole 255 in the direction shown by the arrow BB in FIG. 16. As the swim fin component 260 moves in the direction shown by the arrow BB in FIG. 16, a greater portion of the swim fin component 260 moves within the cavity defined by the sole 255. This causes the walls of the sole 255 to move the blades 262, 264 of the swim fin component 260 with respect to one another. This movement causes the protrusion 265 of the second blade 264 to slide within the aperture 263 defined by the first blade 262. As the protrusion 265 slides within the aperture 263, the first blade 262 overlaps a greater portion of the second blade 264. Further, as the swim fin component 260 moves in the direction shown by the arrow BB in FIG. 16, the first aperture 270 and the second aperture 272 are compressed. This allows the swim fin component 260 to be disposed within the cavity defined by the sole 255 as shown in FIG. 17. In other embodiments, a portion of the swim fin component remains disposed outside the cavity defined by the shoe sole when the swim fin component is in the retracted position.

In some embodiments, instead of an aperture, the first blade 262 defines a recess (not shown) within which protrusion 265 is configured to slide. In other embodiments, the aperture (or recess) is defined by the second blade and the protrusion is positioned on the first blade.

Some embodiments include a gripping member and/or a locking member to aid in moving and/or locking the swim fin component in an extended and/or retracted position. For example, a gripping member and a locking member can be combined to allow a user to conveniently extend or retract a swim fin component to reconfigure the amphibious shoe between a walking mode and a swimming mode. The gripping member can also be configured to lock the swim fin component in place. A suitable gripping member can be a rod or other such protrusion fixedly attached to an edge at a proximal end of a swim fin component. The gripping member extends through a slot or channel in the side of a cavity defined by a shoe sole. A locking member is coupled to the gripping member. The locking member is configured to retain the swim fin component in an extended or a retracted position.

Figure 18:
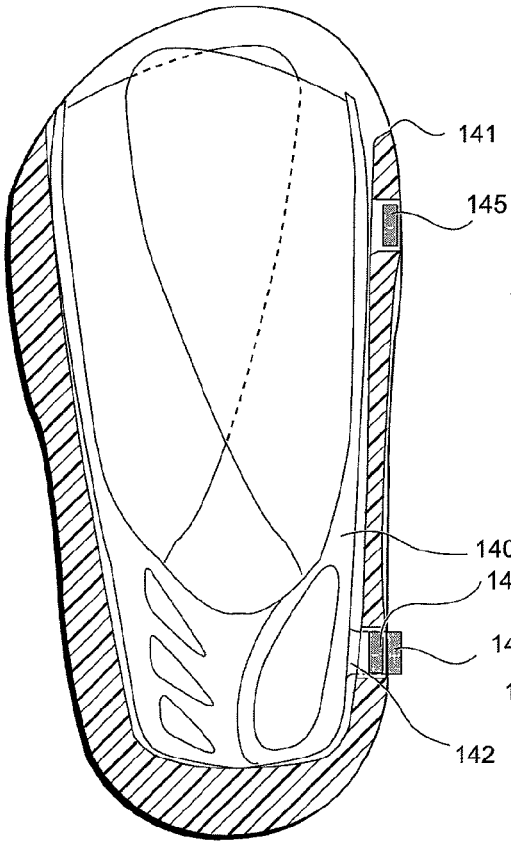
FIGS. 18 and 19 depict top orthogonal views of a swim fin component in a retracted position and an extended position, respectively, according to an embodiment.
Figure 19:
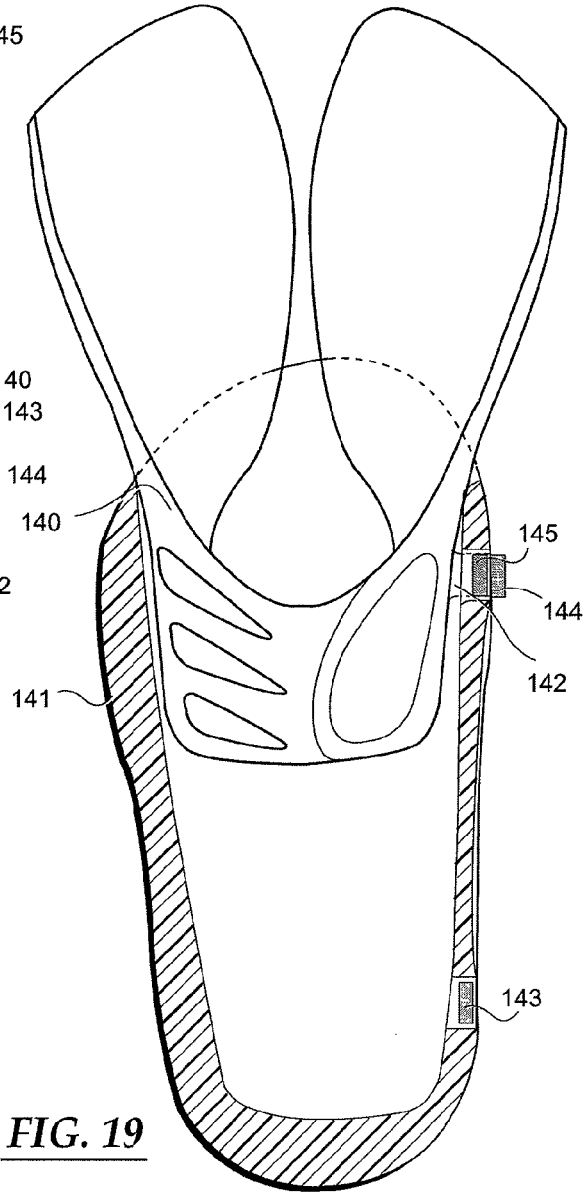

FIGS. 18 and 19 illustrate an example of a gripping member 142 having a locking mechanism, according to an embodiment. A swim fin component 140 is disposed within a cavity defined by a sole 141. The sole 141 includes a first magnet 143 (shown having a negative polarity) disposed near a heel end portion of a side slot in sole 141 and a second magnet 145 (shown having a negative polarity) disposed near a toe end portion of a side slot in sole 141. The swim fin component 140 has a gripping member 142. The gripping member 142 can be a protrusion having a swim fin component magnet 144 (shown having a positive polarity). The magnets 144, 145, 143 are oriented such that the first magnet 143 and the second magnet 145 in the sole 141 each attract the swim fin component magnet 144. Such magnetic attraction functions effectively as a locking mechanism.

In other embodiments, the polarity of the magnets can be switched. For example, the first magnet and the second magnet can have a positive polarity and the swim fin component magnet can have a negative polarity. In some embodiments, only one of the heel end portion of the sole or the toe end portion of the sole has a magnet. In such an embodiment, the swim fin component is magnetically lockable in only one of a retracted position or an extended position. In other embodiments, the magnets can be fixedly attached to the surfaces of the sole and swim fin components, or can be contained within the sole and swim fin components or combinations thereof. In yet other embodiments, either the swim fin component or the sole may include a magnet and the complementary component may include a material attractable by such a magnet. In some embodiments, the magnet can be a ferromagnetic material and the attractable material can be iron or an alloy thereof.

While the swim fin component magnet 144 is shown in FIGS. 18 and 19 as not overlapping the first magnet 143 or the second magnet 145, respectively, in other embodiments, the swim fin component magnet is configured to overlap the first magnet when in a retracted position or the second magnet when in an extended position. Said another way, in such an embodiment, the swim fin component magnet is disposed on top of the first magnet when in the retracted position or the second magnet when in the extended position. In still other embodiments, the swim fin component magnet can be positioned with respect to the first magnet when in the retracted position or the second magnet when in the extended position in any manner configured to lock the swim fin component in the retracted position or the extended position, respectively.

Figure 20:
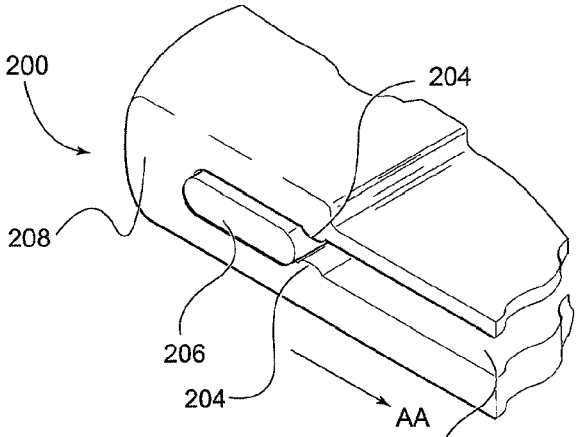
FIG. 20 depicts a portion of an amphibious shoe, according to an embodiment.

While a magnetized gripping member is shown above, FIG. 20 shows another example of a gripping member with a locking mechanism, according to an embodiment. FIG. 20 shows a side perspective view of a gripping member 206 of a swim fin component that is disposed within a side slot 202 defined by a side portion 200 of a sole. The gripping member 206 is configured to slide within the side slot 202 defined by the side portion 200 of the sole between a heel end portion 208 of the sole and a toe end portion (not shown) of the sole. When the gripping member 206 slides within the side slot 202 between the heel end portion 208 and the toe end portion, the swim fin component moves between a retracted position and an extended position, respectively.

The side portion 200 of the sole includes two ridges 204 disposed within the side slot at the heel end portion 208 of the sole. The two ridges 204 help limit undesired movement of the gripping member 206 in the direction shown by the arrow AA in FIG. 20. In this manner, the ridges 204 help prevent the swim fin from moving out of its retracted position. Said another way, the ridges 204 help lock the swim fin in its retracted position.

The gripping member 206 is configured to pass between the two ridges 204 when a significant force is applied to the gripping member 206 in the direction shown by the arrow AA in FIG. 20. For example, when a user pulls and/or pushes the gripping member 206 in the direction shown by the arrow AA in FIG. 20, the gripping member 206 passes between the two ridges 204. Thus, when a user wishes to move the swim fin from its retracted position to its extended position, the user moves the gripping member 206 in the direction shown by the arrow AA in FIG. 20. This causes the gripping member 206 to slide within the side slot 202 in the direction shown by the arrow AA in FIG. 20, past the two ridges 204, and to the toe end portion (not shown) of the side slot 202. This causes the swim fin component to move from the retracted position to the extended position.

Similar to the heel end portion 208 of the side slot 202, the toe end portion (not shown) of the side slot 202 can have two ridges that are structurally and functionally similar to the two ridges 204 of the heel end portion 208 of the side slot 202. The two ridges at the toe end portion of the side slot 202 can, for example, lock the swim fin in its extended position.

In other embodiments, the locking member includes spring tension mechanisms, friction mechanisms, nut and bolt mechanisms, magnets, removable pins, buttons, ties, straps and/or the like. For example, the locking member can include a spring-loaded mechanism that biases the swim fin component in the extended position. The locking member can further include a push button on a side of the shoe and/or a removable pin configured to hold the swim fin component in the retracted position. In such an embodiment, when the button is pressed and/or the pin removed, the swim fin component moves from the retracted position to the extended position. In yet other embodiments, a proximal end portion of the swim fin component can function similar to a button, such that when the toe end of the swim fin component is pressed, the swim fin component moves from the retracted position to the extended position. In other embodiments, the swim fin component is biased in the retracted position and pressing the button and or removing the pin moves the swim fin component from the extended position to the retracted position.

In yet other embodiments, the locking member includes a push button on one side of the shoe and a gripping member on the other side. To move the swim fin from the extended position to the retracted position, or vice versa, the button must be pushed and the griping member moved, as described above.

In some embodiments, the gripping member and the locking member are disposed on the outer side of the shoe, i.e., the side of the shoe that faces away from the other shoe. In other embodiments, the gripping member and locking member are disposed on the inner side of the shoe, i.e., the side of the shoe that faces the other shoe. In still other embodiments, the shoe includes two gripping members and/or two locking members disposed on both sides of the shoe. In certain embodiments the gripping member is a rod-like protrusion with a screw-threaded distal end that accepts a retaining nut as a locking member.

The various components of an amphibious shoe can be constructed of various materials. For example, in some embodiments the components can be constructed of flexible plastics, thermoset rubbers, thermoplastic elastomers, elastomeric polymer alloys and/or the like. Materials such as styrenic block copolymers, polyolefin copolymers, ethylene vinyl acetate (EVA) copolymers, cured polyurethanes, thermoplastic polyurethanes, thermoplastic copolyesters, thermoplastic polyamides, polyvinyl chloride (PVC) compositions as well as combinations, blends and alloys thereof can also be used. In other embodiments, reinforced polymer composites are used.

In certain embodiments, combinations of the various components are parts of a unified or monolithic construction. In certain other embodiments, the inner sole or footbed and the midsole are combined as a single shoe sole component. Such unified construction can be conveniently achieved by use of any of the various techniques known in the art for molding polymers including, but not limited to, compression molding, injection molding, liquid injection molding (LIM), reaction injection molding (RIM) and/or the like. In certain other embodiments, unified construction is achieved by fusing individual components via known techniques including, but not limited to, gluing, ultrasonic welding, vibration or friction welding, laser welding, solvent welding and/or the like.

Some embodiments have an open-ended cassette or cartridge within a shoe sole cavity that functions as a sleeve and/or liner between the surface of the shoe sole cavity and a swim fin component disposed therein. Such a cassette or cartridge is shaped and configured such that it substantially fits within the shoe sole cavity and that the outer surface of the cassette is in substantial contact with the inner surface of the shoe sole cavity. Both the shoe sole cavity and the cassette or cartridge have an open toe end that permits a swim fin component, disposed within the cassette or cartridge, to slidably extend and retract. In some embodiments such a cassette or cartridge includes a longitudinally oriented cassette slot extending through a side wherein such a cassette slot is aligned with a corresponding sole cavity side slot such that the slots can accommodate a rod-like gripping member affixed to an appropriate proximal edge of a swim fin component. Furthermore, such a cassette or cartridge is useful in embodiments in which the shoe sole cavity is defined by the combination of a midsole recess and an inner sole as well as embodiments in which the shoe sole is of a unitary structure. Such a cassette may be incorporated into the shoe sole during a molding operation or may be slid into the shoe sole cavity and secured by glue, a weld and/or the like.

In some embodiments, the cartridge or cassette functions as a low-friction sleeve or liner to assist the sliding movement of a swim fin component as it is extended and retracted within the shoe sole cavity. Further, in some embodiments, the cassette or cartridge provides a protective environment for the swim fin component when in the retracted position.

Materials useful in construction of such a cassette or liner include, but are not limited to, polyolefins such as polyethylenes (PE, HDPE, LLDPE), polypropylenes (PP), ethylene vinyl acetate (EVA), acrylonitrile/butadiene/styrene terpolymers (ABS), thermoplastic polyurethanes (TPU) and/or the like, as well as copolymers, alloys and/or blends thereof. In some embodiments the sleeve is comprised of a material with a coefficient of friction that is lower than that of the material from which the adjacent components are comprised. In some embodiments, a cassette or cartridge is constructed of a material that is harder than the material of which the swim fin component, midsole and inner sole are constructed as indicated by a higher durometer designation as measured by ASTM D2240 type A and type D scales.

Figure 21:
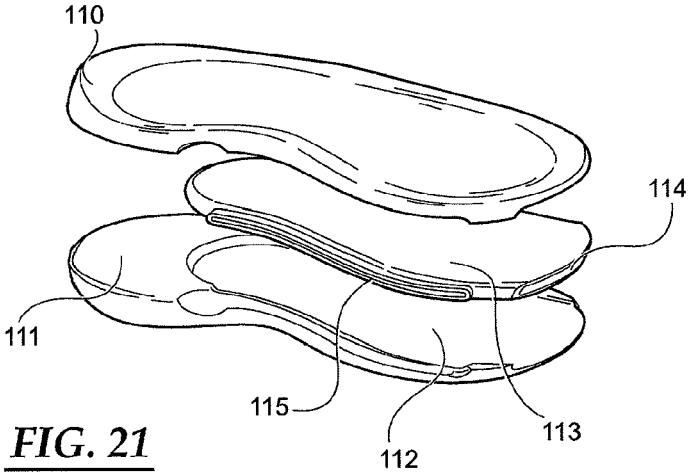
FIG. 21 depicts an exploded isometric view of a cassette disposed within the cavity of a shoe sole constructed from a top sole and midsole, according to an embodiment.

FIG. 21 shows an exploded isometric view of a cassette 113 disposed within a midsole cavity 112 defined by a top sole 110 and a midsole 111. The cassette 113 defines an aperture at a toe end 114 and defines a cavity configured and sized to house a swim fin component. The swim fin component is slidably disposed within the cavity. The cassette 113 also defines a side slot 115 through which a gripping member can extend through. The gripping member can be used to slide the swim fin component between a retracted position and an extended position.

Figure 22:
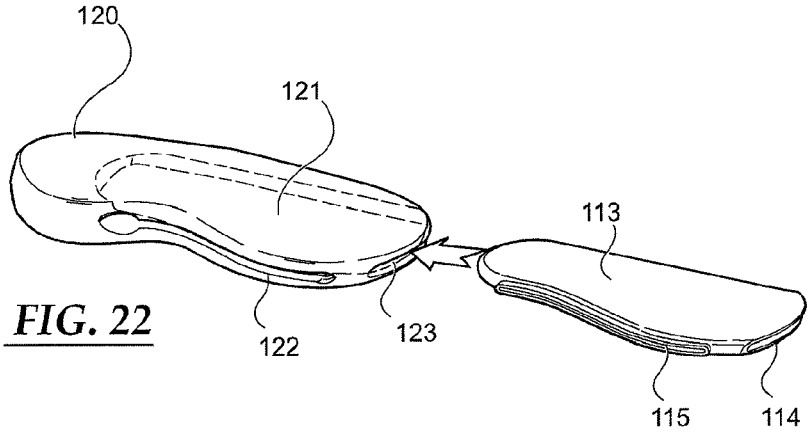
FIG. 22 depicts an isometric view of schematic assembly of a swim fin cassette and a unitary shoe sole with a cavity, according to an embodiment.

FIG. 22 shows an exploded isometric view of a unitary shoe sole 120 defining a shoe sole cavity 121, a shoe sole side slot 122 and a shoe sole toe opening 123. The shoe sole toe opening provides access to the shoe sole cavity 121. A cassette 113 defining a cassette side slot 115 and an open toe end 114 can be inserted into the shoe sole cavity 121 through the shoe sole toe opening 123. Once the cassette 113 is disposed within the shoe sole cavity 121, the shoe can be used as an amphibious shoe.

In some embodiments, the cassette 113 can be removed from the shoe sole cavity 121 when the shoe is not being used as an amphibious shoe. In such embodiments, the cassette can be replaced by a spacer (not shown). The spacer fills and/or maintains the shoe sole cavity 121 when the cassette 113 is not disposed within the shoe sole cavity 121. The spacer can be removed from the shoe sole cavity 121 and replaced with the cassette 113 once the user wishes to use the shoe as an amphibious shoe.

Figure 23:
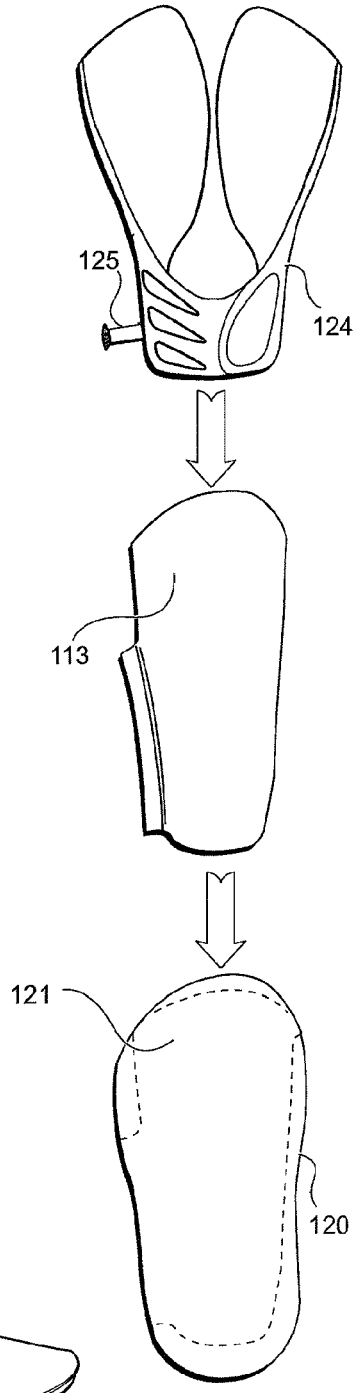
FIG. 23 depicts a top orthogonal view of a schematic assembly of a swim fin component, a cassette and a unitary shoe sole with a cavity, according to an embodiment.

FIG. 23 illustrates the relationship between the shoe sole 120, the cassette 113 and a swim fin component 124. The swim fin component 124 is disposed within the cassette 113 which is disposed within the shoe sole cavity 121. A gripping member 125 can extend through the cassette side slot 115 and the shoe sole side slot 122. The gripping member 125 allows a user to move the swim tin component between the extended position and the retracted position.

Figure 24:
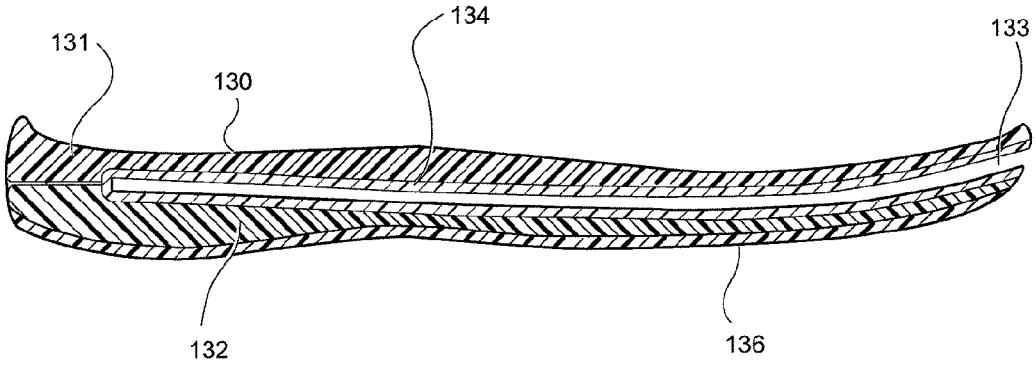
FIG. 24 depicts a sectional orthogonal side view of a fin cassette disposed with the cavity of a multi-element shoe sole, according to an embodiment.
Figure 25:
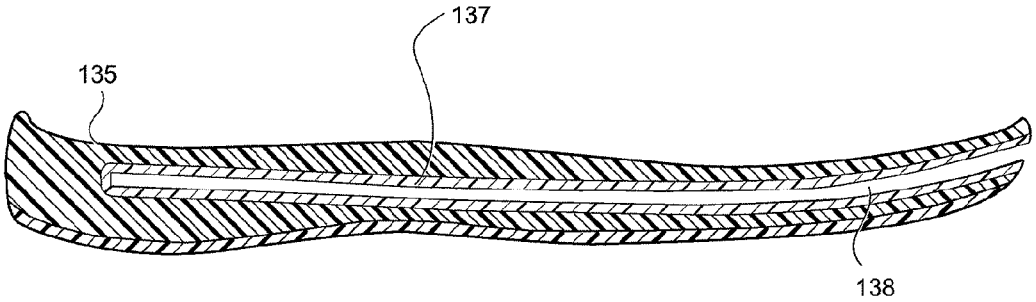
FIG. 25 depicts a sectional orthogonal side view of a fin cassette disposed with the cavity of a unitary shoe sole, according to an embodiment.

FIG. 24 shows a sectional orthogonal side view of an embodiment of a sole assembly 130 having an insole 131, a midsole 132 and a bottom sole 136. The sole assembly 130 defines a shoe sole cavity 133. A cartridge or cassette 134 is disposed within the shoe sole cavity 133. While FIG. 24 is constructed in various pieces, FIG. 25 shows a sectional orthogonal side view of an embodiment of a sole assembly having a unitary shoe sole 135. A cartridge or cassette 137 is disposed within a cavity 138 defined by the shoe sole 135.

Figure 26:
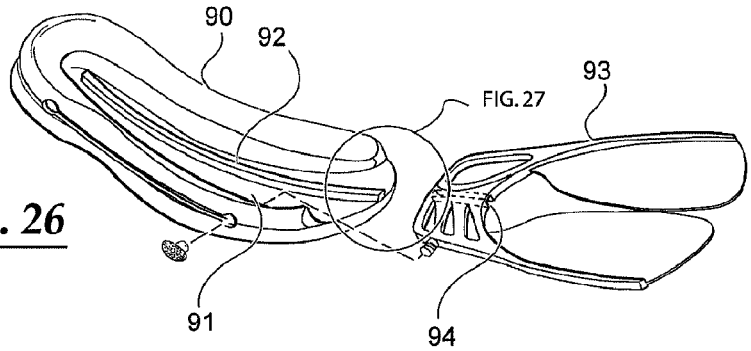
FIG. 26 depicts an exploded isometric view of a shoe midsole and a swim fin component in an extended position.
Figure 27:
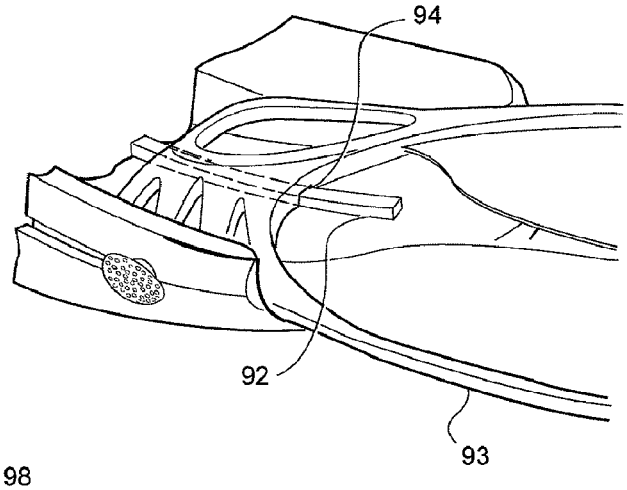
FIG. 27 depicts a magnified partial isometric view of the shoe midsole and the swim fin component shown in FIG. 26 in an extended position.

FIGS. 26 and 27 show a midsole 90 and a swim fin component 93 according to an embodiment. The midsole 90 has a guide rail 92 disposed on the bottom surface of a midsole recess 91 defined by the midsole 90. The swim tin component 93 defines a channel 94 that extends longitudinally to an area between the fin blades. The channel 94 is configured to receive the guide rail 92. In this manner, the swim fin component 93 is slidably coupled to the midsole 90. The guide rail 92 helps facilitate the extension and retraction of the swim fin component 93. While shown in FIGS. 26 and 27 as having a substantially rectangular or square cross-section, the guide rail and the mating channel can have any suitable shape or cross-section. Other suitable cross-sectional geometries include, but are not limited to, trapezoidal, semicircular, triangular and/or combinations thereof.

Figure 28:
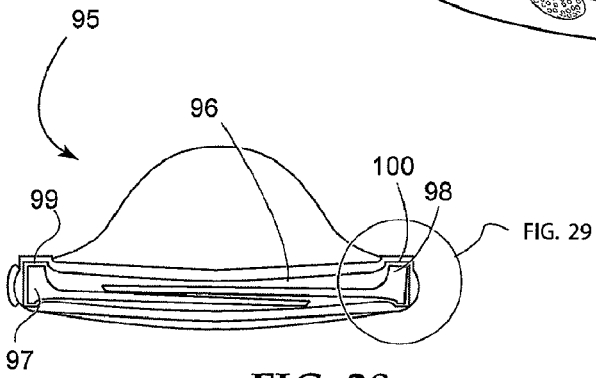
FIG. 28 depicts a frontal orthogonal view of an embodiment of a swim fin component in a retracted position.
Figure 29:
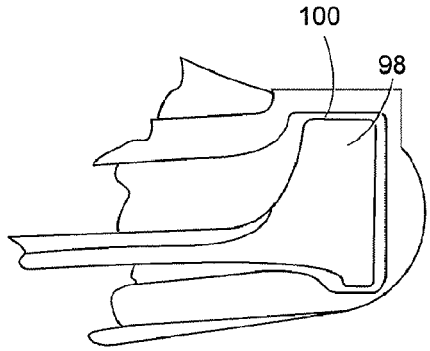
FIG. 29 depicts a magnified portion of FIG. 28.

FIGS. 28 and 29 show an amphibious shoe 95, according to an embodiment. Amphibious shoe 95 includes a swim fin component 96 having a first rib 97 and a second rib 98 along the outer edges of the swim fin component 96. The first rib 97 and the second rib 98 are slidably disposed within a first guide channel 99 and a second guide channel 100 defined along the sides of the shoe sole cavity 96, respectively. FIG. 29 shows an expanded view of a portion of FIG. 28 showing the second rib 98 disposed within the second guide channel 100. Ribs 97, 98 stabilize the swim fin component during extension and retraction. While FIGS. 28 and 29 show the ribs 97, 98 and the guide channels 99, 100 having geometrical cross-sections that are substantially rectangular, in other embodiments other suitable cross-sectional geometries, such as, for example, trapezoidal, semicircular, triangular and/or combinations thereof can be used.

While shown in the above embodiments as being a certain shape, the blades of the swim fin component can be any shape suitable to allow a user to effectively displace water. For example, in some embodiments the blades can be substantially circular, oval, square, rectangular and/or any satisfactory shape. In some embodiments, the blades also include at least one void to help optimize the displacement of water during the kicking motion of swimming.

In some embodiments, the guide channels 99, 100 can be made of and/or coated with a low friction material. For example, low-friction material can be inserted and/or molded to the guide channels 99, 100. This allows the ribs 97, 98 of the swim fin component 96 to easily slide within the guide channels 99, 100 when the swim fin component is moved between its extended position and its retracted position.

In some embodiments, a shoe can be converted into an amphibious shoe using a conversion kit. The conversion kit can include a swim fin component having a proximal end portion and a distal end portion. The distal end portion of the swim fin component includes at least one fin blade. A first edge of the proximal end portion of the swim fin component includes a gripping member. The gripping member is configured to move the swim fin component between a retracted position and an extended position, as described herein.

The conversion kit also includes an open-ended cassette. The swim fin component is configured to be slidably disposed within a cavity defined by the cassette. The swim fin component can move between a retracted position where the swim fin component is disposed within the cavity defined by the cassette and an extended position where the distal end portion of the swim fin component is disposed outside the cavity defined by the cassette.

The cassette is configured to be disposed within a cavity defined by the sole of a shoe. The cavity defined by the sole of the shoe is configured and dimensioned to contact an outer surface of the cassette. The cassette and the sole of the shoe have longitudinally oriented slots configured to allow the gripping member of the swim fin component to slidably move within the slots. In this manner, the gripping member moves the swim fin component between the retracted position and the extended position. The gripping member is coupled to a locking mechanism enabling the fin to be secured in both retracted and extended positions.

Such kits are adaptable to any shoe construction that permits fabrication of a suitable cavity in the sole or sole assembly. Furthermore, the cassette may be disposed within the cavity during or after fabrication of the shoe.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above.

For example, the blades of a swim fin component could be coupled together in a variety of ways. In some embodiments, for example, the blades of a swim fin component could be hingedly coupled together. In other embodiments, the blades might not be coupled together and operate independently from each other. This would allow a user to extend one blade and not the other.

Additionally, the manner in which the user moves a swim fin component could be any suitable manner. For example, in some embodiments, the swim tin component could be spring-loaded. In such an embodiment, the swim fin component could be biased in the retracted position or the extended position. In other embodiments, the swim fin component is moved from the retracted position to the extended position by overcoming a predetermined force. For example, the swim tin component can be configured to move from the retracted position to the extended position when a user wearing the shoe kicks. The force of the kick moves the swim fin component from the retracted position to the extended position.

In some embodiments, the swim fin component is configured to be rolled-up when in a retracted position. The swim fin component unrolls when it is moved from the retracted position to the extended position. The locking mechanism used from such an embodiment, can be any locking mechanism previously described such as a tie and/or a strap to configured to maintain the swim fin component rolled-up when in the retracted position.

Although various embodiments have been described as having particular features and/or combinations of components, other embodiments are possible having a combination of any features and/or components from any of embodiments where appropriate. For example, any of the above described embodiments can have ribs similar to the ribs 97, 98 of amphibious shoe 95.

What is claimed is:

1. An apparatus, comprising:

an upper portion configured to at least partially cover a foot;

a sole coupled to and unitarily formed with the upper portion, the sole defining a cavity therein; and a fin including a first portion and a second portion, the fin being movable between a first configuration in which the fin is substantially within the cavity and a second configuration in which the fin extends substantially outside a toe end of the cavity.

2. The apparatus of claim 1, wherein the first portion of the fin and the second portion of the fin are physically distinct.

3. The apparatus of claim 1, the fin including a first end that is maintained substantially within the cavity in both the first configuration and the second configuration and a second end that is outside the cavity in the second configuration, the apparatus further comprising a control element coupled adjacent the first end of the fin.

4. The apparatus of claim 1, wherein the fin is configured to be releasably locked in at least one of the first configuration or the second configuration.

5. The apparatus of claim 1, wherein the fin includes a substantially rigid rib along an edge of the first portion of the fin and the cavity defines a guide channel along which the substantially rigid rib is configured to move when moving between the first configuration and the second configuration.

6. The apparatus of claim 1, further comprising:

a magnetic locking mechanism configured to releasably lock the fin in at least one of the first configuration or the second configuration.

7. The apparatus of claim 1, wherein the first portion of the fin is slidably coupled to the second portion of the fin.

8. The apparatus of claim 1, wherein the fin can be removed from the cavity of the sole and a spacer placed within the sole.

9. An apparatus, comprising:

a housing configured to be coupled to a foot cover, the housing defining a cavity, and an opening in communication with the cavity;

a fin configured to move between a first configuration in which at least a portion of the fin is within the cavity and a second configuration in which the fin is extended through the opening and is substantially outside of the cavity; and a control element coupled to a side portion of the fin, the control element configured to move the fin between the first configuration and the second configuration.

10. The apparatus of claim 9, wherein the housing is configured to be removably coupled to at least one of a shoe, a sandal, a boot or a sock.

11. The apparatus of claim 9, further comprising:

a magnetic locking mechanism configured to releasably lock the fin in at least one of the first configuration or the second configuration.

12. An apparatus comprising:

an upper portion;

a sole coupled to the upper portion; and a fin slidably coupled to the sole, the fin including a first portion and a second portion, the second portion of the fin being movably coupled to the first portion of the fin, the fin being movable between a first configuration and a second configuration, the fin having a first width when in the first configuration and a second width when in the second configuration, the second width being larger than the first width, the first portion at least partially overlapping the second portion external to the sole when in the second configuration.

13. The apparatus of claim 12, wherein the fin is substantially disposed within a cavity defined by the sole when the fin is in the first configuration.

14. The apparatus of claim 12, wherein the fin extends substantially outside a cavity defined by the sole when the fin is in the second configuration.

15. The apparatus of claim 12, wherein the sole defines a width that is smaller than the second width.

16. The apparatus of claim 12, wherein the sole defines at least one aperture configured to allow a fluid to flow through the aperture.

17. The apparatus of claim 12, further comprising:

a locking mechanism configured to help maintain the fin in at least one of the first configuration or the second configuration.

18. The apparatus of claim 12, wherein the first portion of the fin includes a protrusion and the second portion of the fin defines an aperture, the protrusion of the first portion of the fin configured to be slidably disposed within the aperture defined by the second portion of the fin.

19. The apparatus of claim 12, wherein the sole defines a first guide channel and a second guide channel, the first guide channel configured to slidingly receive a rib of the first portion of the fin and the second guide channel configured to slidingly receive a rib of the second portion of the fin.

* * * * *